US007192358B2

(12) United States Patent
Knupp

(10) Patent No.: US 7,192,358 B2
(45) Date of Patent: Mar. 20, 2007

(54) TWO-PIECE DIAMONDS BILLIARDS RACK

(75) Inventor: Michael E. Knupp, Bonita Springs, FL (US)

(73) Assignee: Michael Eugene Knupp, Bonita Springs, FL (US)

( * ) Notice: Subject to any disclaimer, the term of this patent is extended or adjusted under 35 U.S.C. 154(b) by 0 days.

(21) Appl. No.: 10/914,473

(22) Filed: Aug. 9, 2004

(65) Prior Publication Data

US 2006/0030416 A1 Feb. 9, 2006

(51) Int. Cl.
*A63D 15/00* (2006.01)

(52) U.S. Cl. ..... 473/40

(58) Field of Classification Search ..... 473/40, 473/41, 26, 21, 1, 22
See application file for complete search history.

(56) References Cited

U.S. PATENT DOCUMENTS 501,256 A * 7/1893 Rohrbach ..... 473/41
3,992,005 A * 11/1976 Richey ..... 473/40
4,307,881 A * 12/1981 Jaworski ..... 473/40
4,469,328 A * 9/1984 Pacitti ..... 473/40
4,984,788 A * 1/1991 Harriman ..... 473/41
5,601,495 A * 2/1997 Silverman ..... 473/40
5,916,032 A * 6/1999 Stoll ..... 473/40
6,261,187 B1 * 7/2001 Tsai ..... 473/40
7,037,206 B2 * 5/2006 Fliedner et al. ..... 473/40

FOREIGN PATENT DOCUMENTS

GB 2156690 A * 10/1985

* cited by examiner

*Primary Examiner*—Mitra Aryanpour

(57) ABSTRACT

Disclosed is a billiard ball racking device consisting of two-pieces (two V-shaped mirror-image sides) which form a diamond-shape capable of racking the balls in the tightest possible position (balls touching each other) and is likewise capable of being removed (withdrawn) without disturbing the balls. The disclosed invention is capable of racking a wide variety of configurations with different multiples of billiard balls. The disclosed invention is three proportionally-sized apparatuses, each size directly relating to the number of billiard balls being racked. The disclosed invention is capable of racking a number of conventional and unconventional configurations. The design of the invention is extremely simple in nature, yet superior in function.

9 Claims, 8 Drawing Sheets

TWO-PIECE DIAMONDS BILLIARDS RACK

CROSS-REFERENCE TO RELATED APPLICATIONS

References Cited (Referenced By)

| U.S. Patent Documents | | | |
|---|---|---|---|
| 228879 | June, 1880 | Gaetano | 473/40 |
| 854799 | May, 1907 | Callahan | 473/40 |
| 1725494 | August, 1929 | Varnum | 473/40 |
| 2219675 | October, 1940 | Gillespie | 473/40 |
| 3399890 | September, 1968 | Galedrige | 473/40 |
| 3672671 | June, 1972 | Merola | 473/40 |
| 3863919 | February, 1975 | Sardelli | 473/40 |
| 3992005 | November, 1976 | Richey | 473/40 |
| 4452450 | June, 1984 | Cayton | 473/40 |
| 5350171 | September, 1994 | Wozniak | 473/1 |
| 5376054 | December, 1994 | Kwasny | 473/40 |
| 5997404 | December, 1999 | Sardo | 473/40 |
| 6068558 | May, 2000 | Gill | 473/40 |
| 6537156 | March, 2003 | Stagg | 473/40 |
| 6595862 | July, 2003 | Porper | 473/40 |
| 6761642 | July, 2004 | Ye | 473/1 |

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

1. Field of Invention

The disclosed invention pertains to the device designed for the racking of billiard balls, specifically, the racking of billiard balls in a diamond-shaped configuration as well as many non-conventional configurations. It is specifically designed to remedy the inherent problems with the currently-available billiard racks of the balls not racking tightly and balls being moved or disturbed upon removal of the rack. Currently, the majority of billiard racks are one-piece devices and fit relatively loosely over the billiard balls, which does not rack the balls tightly. Players normally attempt to use their fingers to force a tighter arrangement. Also, with the currently-available racks being one piece, removing the rack without disturbing the balls is almost impossible. The optimal goal is for each billiard ball to be in direct contact with each other. Tight racking of the balls is of the utmost importance to a good and true break of the balls.

There is a need for a billiard ball rack which is simple in its design and construction, yet superior in its function. The present invention will accomplish these goals and provide additional multi-ball racking capabilities of multiple configurations.

2. Description of the Prior Art

All billiard games require the tight racking of the billiard balls (all balls touching each other.) Numerous popular billiard games are described in the "*Billiard: The Official Rules &Records Book*" published by the Billiard Congress of America. This book describes in great detail the rules for playing 7-ball, 9-ball and poker pool. It explains the equipment (diamond-shaped racks) that is needed to play these games, and also emphasizes the need to have the balls tightly racked. All currently-available billiard racks are one-piece apparatuses and therefore have the inherent problems as previously stated above of loosely-racked balls. Another billiard game described in "*Official* 16-*Ball Rules and Regulations*," copyright 2004, 16-Ball, Inc., also racks billiard balls into a 16-ball, diamond-shaped configuration.

The great majority of currently-available billiard racks are one-piece, triangular-shaped or diamond-shaped devices. They support a very limited number of billiard ball-racking configurations and, therefore, a limited number of billiard games. The great majority of billiard games being played today, i.e., 8-ball, 9-ball, have changed little since the early 1900s. The currently available diamond-shaped racks are one-piece devices and support only one configuration.

The current invention, being a two-piece device allows for a multitude of non-conventional configurations, one of which is demonstrated in FIG. 4. The current invention, therefore, opens the door to the creation of new, innovative billiard games with multiples of different numbers of billiard balls and different configurations.

BRIEF SUMMARY OF THE INVENTION

The present invention brings radical improvements to today's typical rack design, specifically the rack being in two pieces rather than one solid piece. This allows the balls to be placed together in as tight a formation as possible. Then, and again via the two-piece construction, the rack is easily removed from each side without disturbing the tightly-racked balls.

The present invention comes in three different sizes, with all heights and widths and angle opening being identical and only length of sides varying with each different size, each being proportional to a varying number of balls it is capable of racking. Each rack is comprised of two mirror-imaged V-shaped sides that when brought together form a diamond shape. (See FIG. 1.) These V-shaped pieces have an angle opening of 120°. The heights and widths on all rack sizes are always the same, i.e., height of 1⅜" and width of ⅜". The lengths of the sides on a particular-sized rack are all exactly the same. The largest rack sides measure 10¼" long (See FIG. 3); the mid-sized rack sides measure 8" long (See FIG. 2); the smaller rack sides measure 5¾" long (See FIG. 1).

Each rack is capable of racking a multiple number of balls in a variety of configurations. Configurations include but are not limited to diamond shaped, hexagonal, and trapezoidal.

All references to number of billiard balls refer to standard-sized billiard balls (2¼" diameters). The largest rack (See FIG. 3) is capable of racking 25 standard-sized billiard balls into a diamond-shaped pattern. This rack is also capable of racking 15, 19, 20, 23, 24, 25, 29, 30 and 34 billiard balls in various unconventional configurations (diamond, hexagonal, trapezoidal). Innovative games introduced in the future will be supported by this racking system.

The mid-sized rack (See FIG. 2) is capable of racking 16 standard-sized billiard balls into a diamond-shaped pattern. This rack is also capable of racking 12, 14, 18, 19 and 23 billiard balls in various unconventional configurations. This rack supports currently-available games (Poker Pool and 16-Ball) and will support innovative games introduced in the future.

The small rack (See FIG. 1) is capable of racking 9 standard-sized billiard balls into a diamond-shaped pattern. This rack is also capable of racking 7 billiard balls in a hex-shaped configuration. This rack is also capable of racking 6, 8 and 14 balls in various unconventional configurations. This rack supports currently-available games (7-Ball, 9-Ball) and will support innovative games introduced in the future.

BRIEF DESCRIPTION OF THE SEVERAL VIEWS OF THE DRAWING

The accompanying drawings illustrate the invention. Such drawings illustrate the following.

DETAILED DESCRIPTION OF THE INVENTION

The present invention, two-piece diamond billiard rack, may be constructed from an assortment of materials. The simplicity of design will allow easy manufacture of the present invention, whether using wood, wood composites, metal, metal composites, ceramic, ceramic composites, plastics, including phenolic resin. The preferred methods of manufacture are wood, plastics (injection molding) and/or phenolic resins.

Manufacturing out of wood products would involve simply the cutting of the sections to the specified dimensions and finishing with a chosen sealer (i.e., paint, wood stain, varnish). The preferred method would entail use of a computerized industrial wood saw that is capable of cutting to perfect specifications with little or no variance. Preferred manufacture would be for each side of the rack to be one solid piece of wood (no cutting or joint at the vertex), although a joint at the vertex would be an alternative method of production.

Manufacturing using injection molding, whether plastics or phenolic resin would involve the production of three molds (three sizes) to the specified dimensions, followed by the injection molding process itself.

Figure 6:
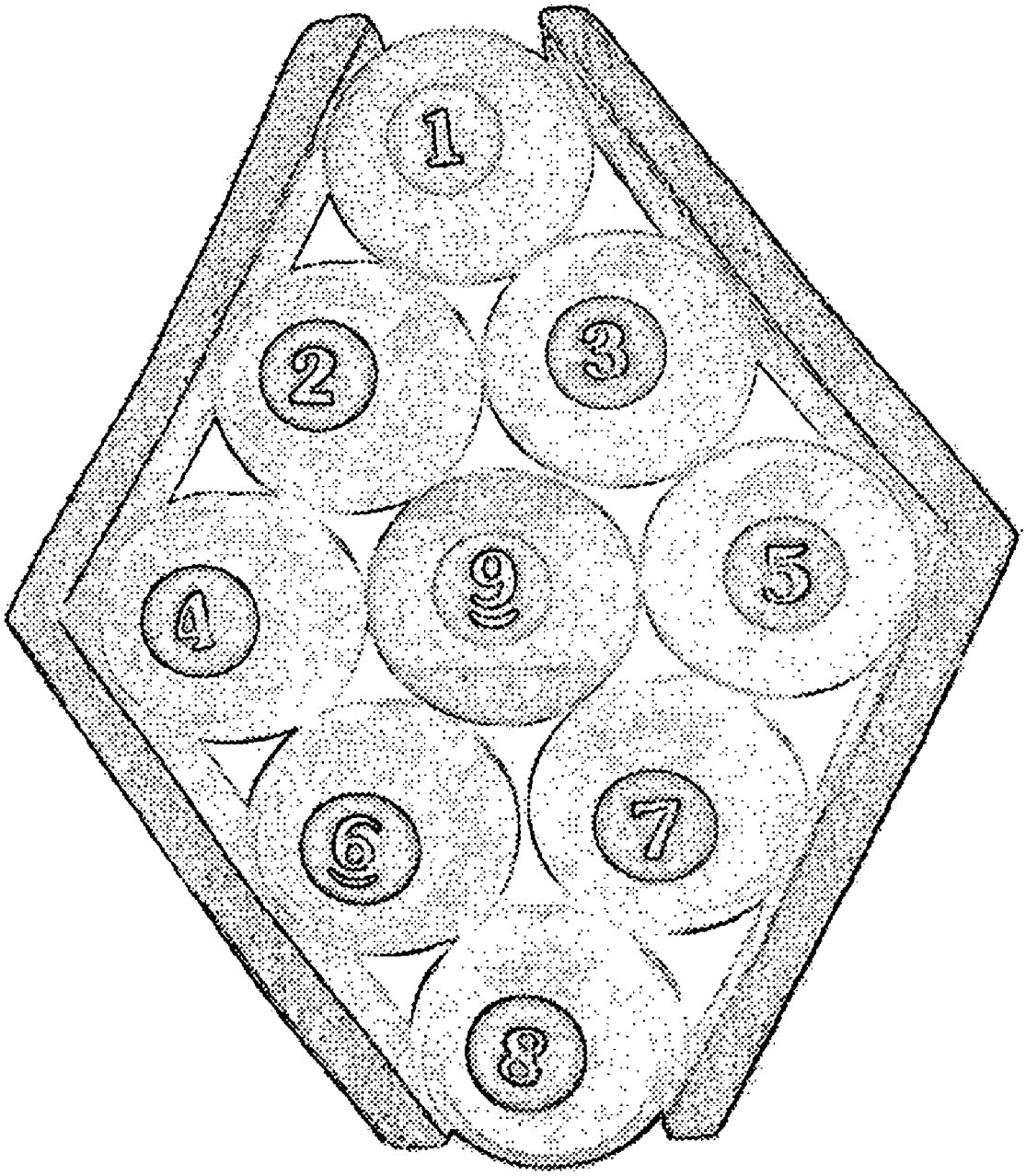
FIG. 6 is a three-dimensional representation of the present invention in its small size, demonstrating racking nine billiard balls into a diamond-shaped configuration.
Figure 7:
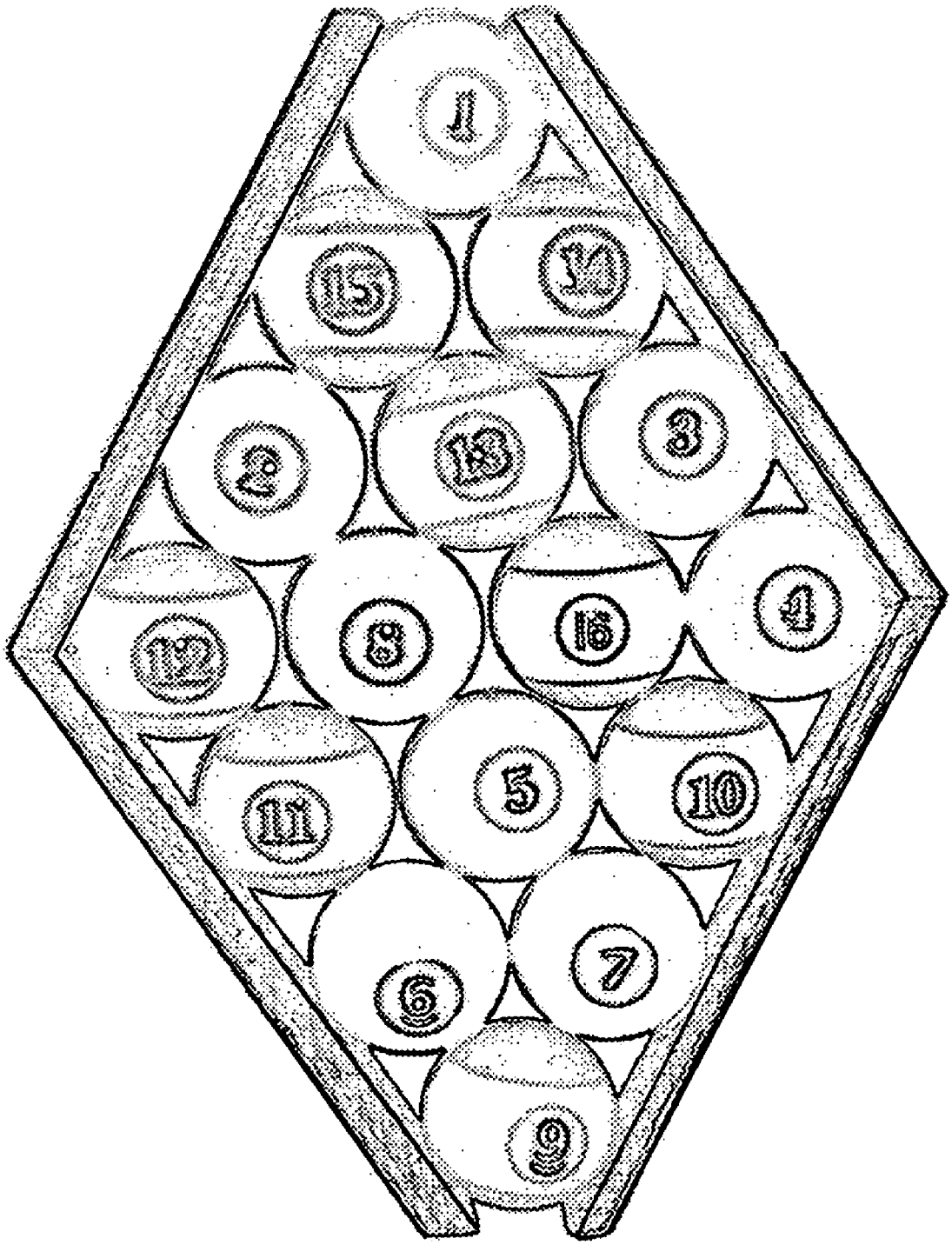
FIG. 7 is a three-dimensional representation of the present invention in its mid size, demonstrating racking 16 billiard balls into a diamond-shaped configuration.
Figure 8:
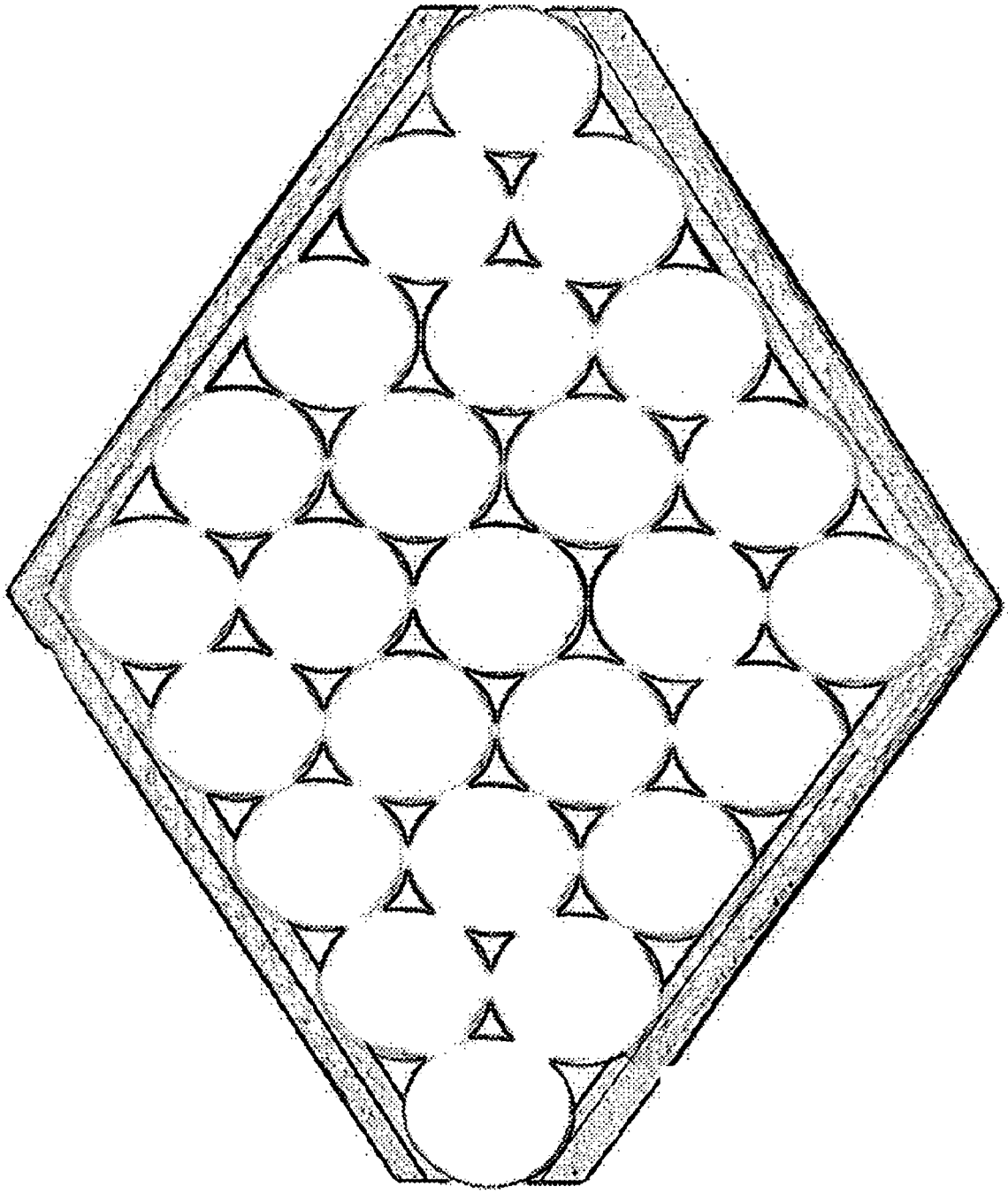
FIG. 8 is a three-dimensional representation of the present invention in its large size, demonstrating racking of 25 billiard balls into a diamond-shaped configuration.

The present invention is a radical improvement not only to existing diamond-shaped billiard racks, but conventional triangular racks, (when used to rack 7 or 9 balls with your fingers) as well. The first major improvement addressed by the present invention is the tight racking of balls along with the easy removal of the rack without disturbing the balls. Due to its two-piece design (See FIG. 1), each end of the rack is open. The lengths of the sides of the three sizes (See FIGS. 1, 2 and 3) are directly proportional to the numbers of billiard balls capable of being racked. In each instance the sides are "shorter" than the maximum number of balls (See FIGS. 6, 7 and 8). Since the ends of each side of the rack do not touch each other, there is no restriction on the tightest possible compaction of the balls. Currently available racks on the market today, whether diamond-shaped or triangular, are one piece in design. They, therefore, must be slightly larger than the balls being racked in order to fit over the balls. This method inherently causes loosely-racked balls.

The second major improvement of the present invention is that it allows for the removal of the rack without disturbing the balls. Currently available racks, being one piece, are almost impossible to remove without bumping or disturbing the racked balls. The present invention, again due to its simple two-piece construction, allows for the withdrawal of the rack from both sides with no touching or disturbing of the now tightly-racked balls.

The dimensions of the present invention are not without important design function. The width, height and angle opening measurements are identical in all sizes. (See Numerals #1, #2 and #3 in FIGS. 1, 2 and 3.) All design dimensions are based on function with the standard-sized billiard balls (2¼" diameter), although the racks will accommodate other sized balls (i.e., British snooker balls, 2⅛"). The angle opening of 120° is a crucial design element. It is the only angle which permits the present invention to function as claimed. (See Numeral #1 in FIGS. 1, 2 and 3.) The width, ⅜", is essential to the easy removal of the rack without disturbing the billiard balls. The rack can be easily "rolled/peeled" away from each side without disturbing the balls. If the width was wider, on rolling the rack away, the rack would touch and disturb the balls. The height, 1⅜", is based on the diameter of the standard-sized billiard ball and permits optimal functionality of the present invention. (See Numeral #3 in FIGS. 1, 2 and 3.)

Figure 1:
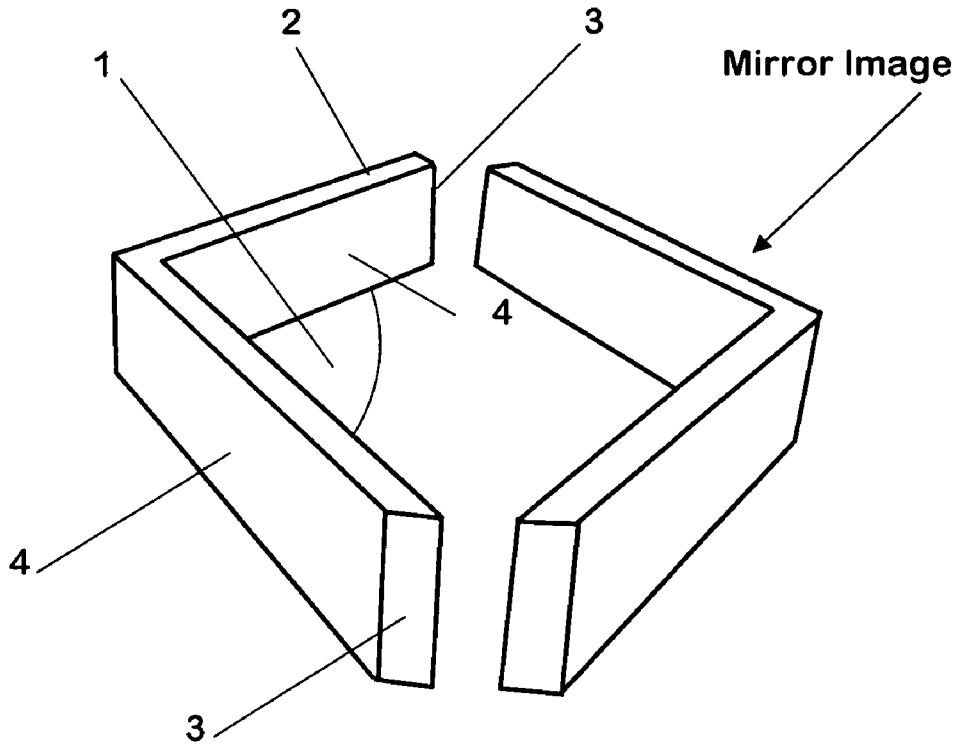
FIG. 1 is a three-dimensional line drawing of the present invention. It is the "small" size of the rack. Numeral #1 represents an opening angle of 120°. Numeral #2 represents a width of ⅜" on the top and bottoms faces of the device. Numeral #3 represents a height of 1⅜" from the top to bottom faces. Numeral #4 represents a length of 5¾" from the front of the device to the vertex point and from the back of the device to the vertex point. Note: Each side of the device is an exact mirror image of the other.
Figure 2:
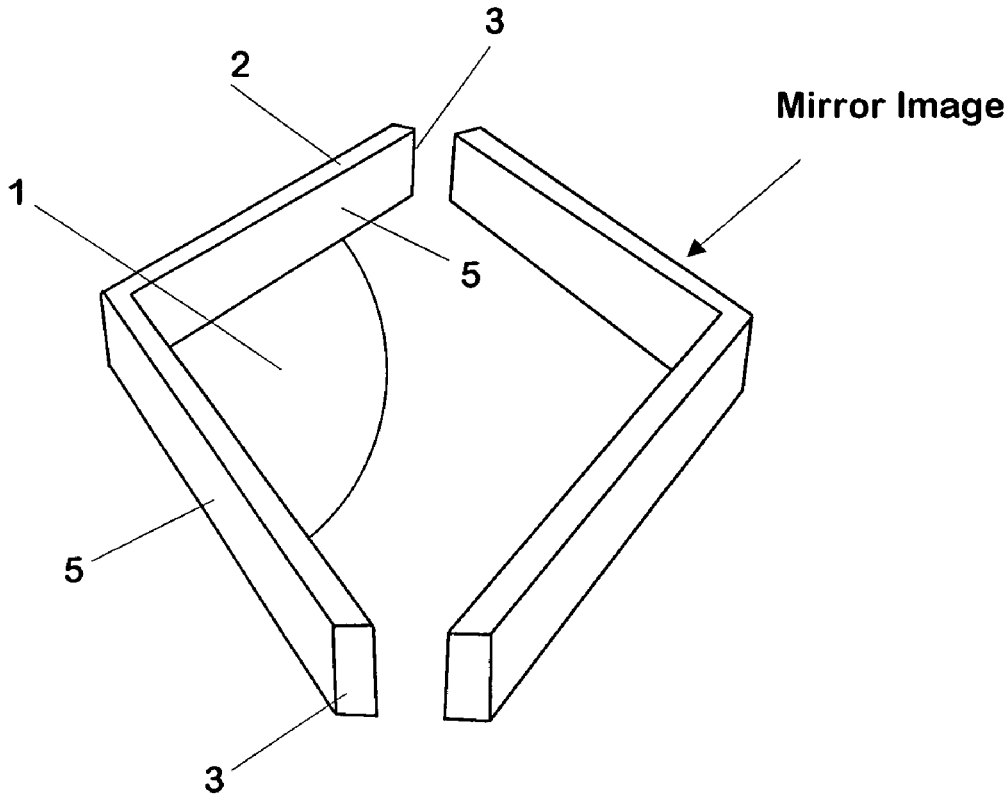
FIG. 2 is a three-dimensional line drawing of the present invention. It is the "mid-size" of the rack. Numeral #1 represents an angle of 120°. Numeral #2 represents a width of ⅜" on the top and bottoms faces of the device on both sides of all device sizes. Numeral #3 represents a height of 1⅜" from the top to bottom faces. Numeral #5 represents a length of 8" from the front of the device to the vertex point and from the back of the device to the vertex point. Note: Each side of the device is an exact mirror image of the other.
Figure 3:
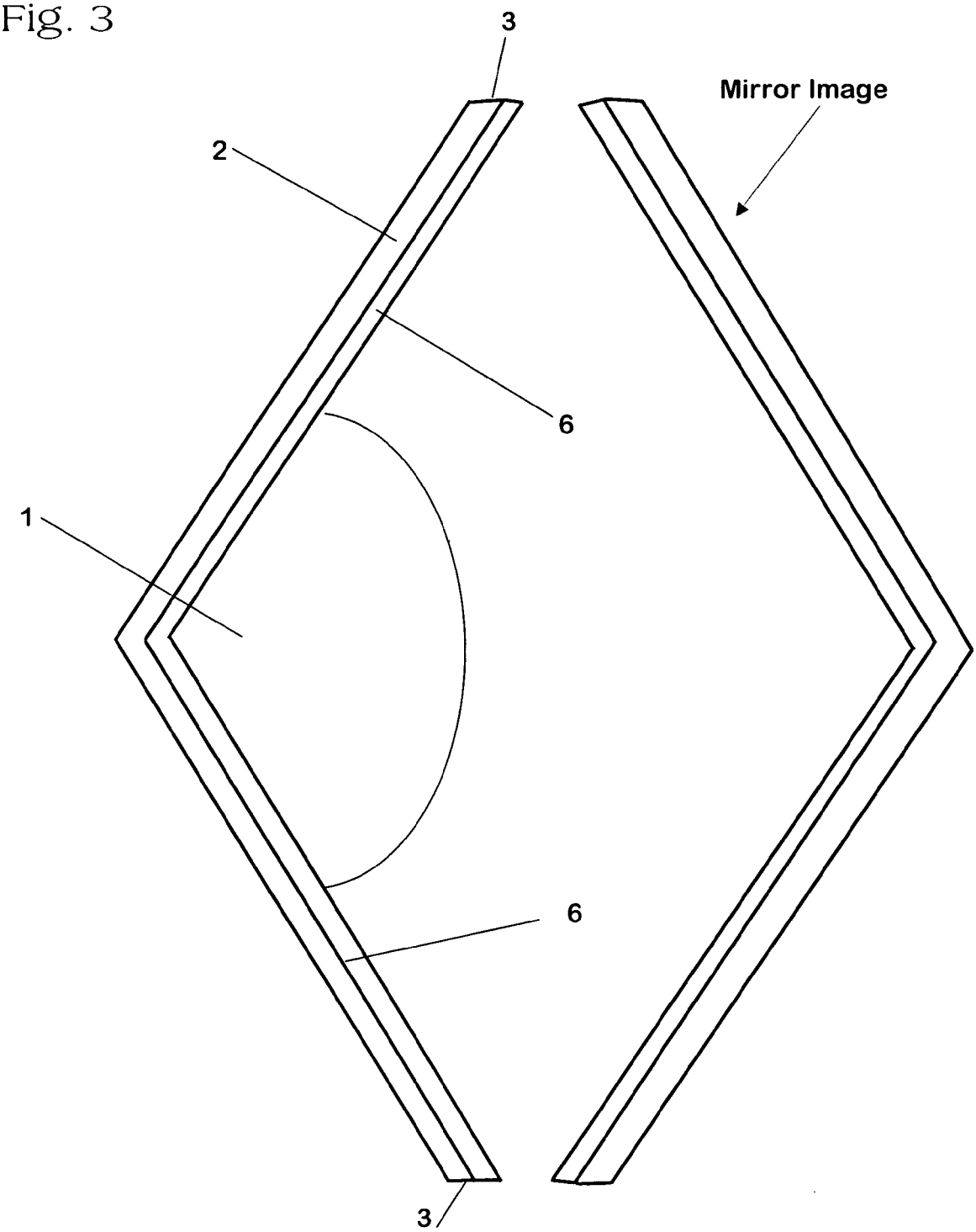
FIG. 3 is a top view, two-dimensional line drawing of the present invention in its largest size, including dimensions. Numeral #1 represents an angle of 120°. Numeral #2 represents a width of ⅜" on the top and bottoms faces of the device on both sides. Numeral #3 represents a height of 1⅜" from the top to bottom faces. Numeral #6 represents a length of 10¼" from the front of the device to the vertex point and from the back of the device to the vertex point. Note: Each side of the device is an exact mirror image of the other.
Figure 4:
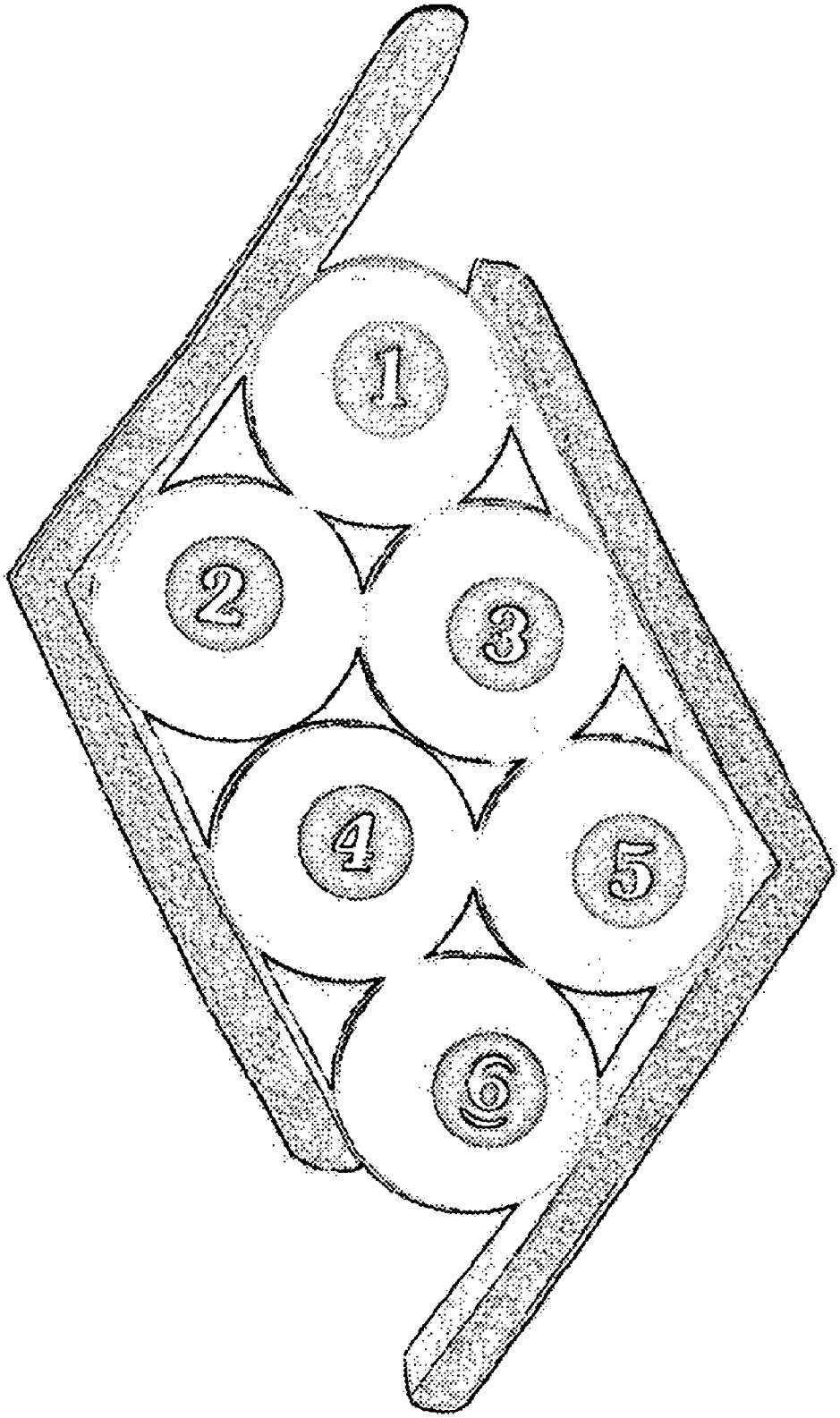
FIG. 4 is a three-dimensional representation of the present invention in its small size, demonstrating racking six billiard balls into a trapezoidal configuration.
Figure 5:
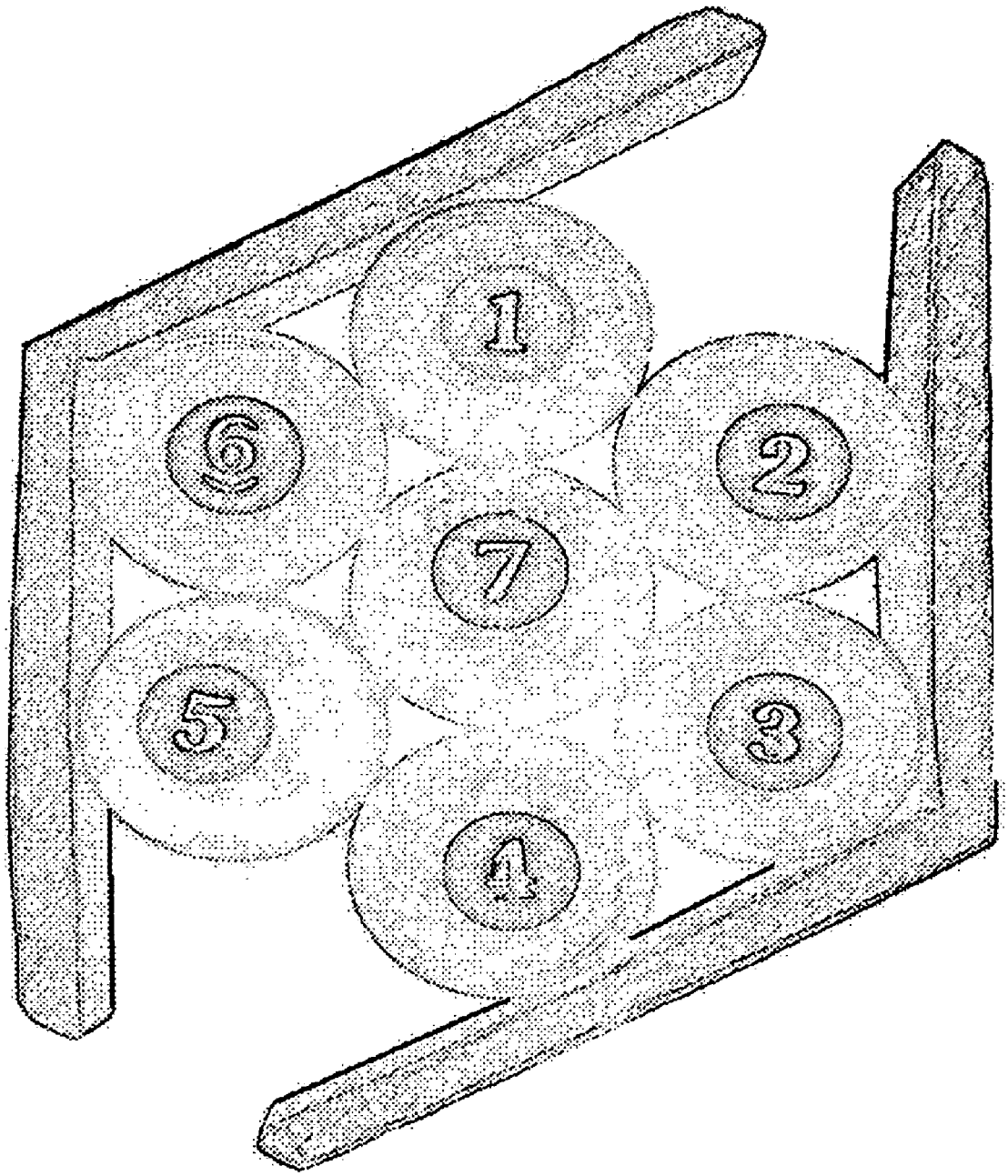
FIG. 5 is a three-dimensional representation of the present invention in its small size, demonstrating racking seven billiard balls into a hexagonal configuration.

The lengths are the only dimensions which vary from size to size. (See Numeral #4, FIG. 1, representing 5¾"; Numeral #5, FIG. 2, representing 8"; Numeral #6, FIG. 3, representing 10¼".) The length of the sides is directly proportional to the number of billiard balls accommodated by each sized rack and the multiple configurations each rack is capable of.

Note: The height and width and lengths could vary ever so slightly from the specified dimensions, however, the angle of 120° can afford no substitution.

The contemplated mode for carrying out the present invention will include manufacture with wood/wood products and plastic/phenolic resin. Distribution and marketing through presently-available channels will be pursued.

What I claim as my invention is:

1. A billiard ball rack device for racking a plurality of billiard balls comprising:

a first V-shaped side having an angle opening of 120 degrees;

a second V-shaped side formed independently and separately of the first V-shaped side and having an angle opening of 120 degrees, the first and second V-shaped sides are mirror images;

the first and second V-shaped sides having a height, a width and a length proportional to the size of the billiard balls and the number of billiard balls used;

wherein the first V-shaped side is moved independently of the second V-shaped side, the first and second V-shaped sides are brought together to rack the plurality of billiard balls in a variety of different configurations; and wherein the plurality of billiard balls are tightly racked and the first and second V-shaped sides are removed without disturbing the plurality of racked billiard balls.

2. The Billiard ball rack device as claimed in claim 1, wherein the plurality of different configurations consisting of a diamond-shaped configuration, trapezoidal configuration, hexagonal configuration and unconventional configuration.

3. The Billiard ball rack device as claimed in claim 1, wherein the first and second V-shaped sides are formed from a material consisting of wood, wood composites, metal, metal composites, ceramic, ceramic composites, plastics and resins.

4. The Billiard ball rack device as claimed in claim 1, wherein the first and second V-shaped sides are formed in three sizes, the three sizes comprising a large size capable of racking in a preferred embodiment 25 billiard balls, a medium size capable of racking in a preferred embodiment 16 billiard balls and a small size capable of racking in a preferred embodiment 7 or 9 balls.

5. The Billiard ball rack device as claimed in claim 1, wherein the first V-shaped rack is formed of a solid piece of material.

6. The Billiard ball rack device as claimed in claim 1, wherein the second V-shaped rack is formed of a solid piece of material.

7. The Billiard ball rack device as claimed in claim 1, wherein the first V-shaped rack is formed from a two piece material and joined at the vertex of the V-shaped rack.

8. The Billiard ball rack device as claimed in claim 1, wherein the second V-shaped rack is formed from a two piece material and joined at the vertex of the V-shaped rack.

9. The Billiard ball rack device as claimed in claim 1, wherein the length of the first and second V-shaped sides are directly proportional to the number of billiard balls racked, and wherein the first and second V-shaped sides are shorter than the maximum number of balls used.

* * * * *